US009428315B2

(12) United States Patent
Liao et al.

(10) Patent No.: US 9,428,315 B2
(45) Date of Patent: Aug. 30, 2016

(54) FOLDABLE AIR CUSHIONED STRUCTURE

(71) Applicants: AIR-BAG PACKING CO., LTD., New Taipei (TW); Tai-An Liao, New Taipei (TW)

(72) Inventors: Tai-An Liao, New Taipei (TW); Chieh-Hua Liao, New Taipei (TW); Yaw-Chuan Liao, New Taipei (TW)

(73) Assignees: AIR-BAG PACKING CO., LTD., New Taipei (TW); Tai-An Liao, New Taipei (TW)

( * ) Notice: Subject to any disclaimer, the term of this patent is extended or adjusted under 35 U.S.C. 154(b) by 0 days.

(21) Appl. No.: 14/614,037

(22) Filed: Feb. 4, 2015

(65) Prior Publication Data

US 2015/0144520 A1 May 28, 2015

Related U.S. Application Data

(63) Continuation-in-part of application No. 13/717,100, filed on Dec. 17, 2012, now abandoned.

(30) Foreign Application Priority Data

Dec. 30, 2011 (TW) ..... 100150094 A

(51) Int. Cl.
*B65D 81/02* (2006.01)
*B65D 85/00* (2006.01)
*B65D 81/05* (2006.01)

(52) U.S. Cl.
CPC ..... *B65D 81/052* (2013.01)

(58) Field of Classification Search
CPC ..... B65D 81/02
USPC ..... 206/522; 383/3
See application file for complete search history.

(56) References Cited

U.S. PATENT DOCUMENTS

| | | | | |
|---|---|---|---|---|
| 5,622,262 | A | 4/1997 | Shadow | |
| 5,624,035 | A | 4/1997 | Kim | |
| 6,010,007 | A | 1/2000 | Moren et al. | |
| 6,286,683 | B1 | 9/2001 | Hunt et al. | |
| 7,066,331 | B2 * | 6/2006 | Koyanagi | B65D 81/052 206/522 |
| 7,448,495 | B2 | 11/2008 | Shadow | |
| 7,770,731 | B2 | 8/2010 | Jian | |
| 7,823,729 | B2 * | 11/2010 | Lee | B65D 81/03 206/521 |
| 8,371,093 | B2 | 2/2013 | Zhang et al. | |
| 2008/0107362 | A1 | 5/2008 | Yoshifusa | |
| 2009/0127153 | A1 | 5/2009 | Kim | |

* cited by examiner

*Primary Examiner* — Nathan J Newhouse
*Assistant Examiner* — Jennifer N Zettl
(74) *Attorney, Agent, or Firm* — Muncy, Geissler, Olds & Lowe, P.C.

(57) ABSTRACT

A foldable air cushioned structure formed by two outer films, comprises a plurality of heat-sealing lines, air cylinders, nodes and clasp points. The heat-sealing lines are arranged in order for attaching parts of two outer films. The air cylinders are positioned between heat-sealing lines. The nodes are formed inside the air cylinders for attaching parts of the inner surfaces of two outer films, and arranged in lines perpendicular to the heat-sealed lines to form foldable lines. The clasp points are formed on the outer surface of two outer films for attaching parts of the outer surfaces of two outer films. After folding the air cylinder along the folding lines, the air cylinders forms two side portions, at least one supporting portion, and at least two bottom portions. The supporting portion forms at least one convex for supporting an object by the pressure along the long-axis of the air cylinder.

9 Claims, 11 Drawing Sheets

FOLDABLE AIR CUSHIONED STRUCTURE

CROSS-REFERENCES TO RELATED APPLICATIONS

This application is a continuation-in-part (CIP) of application Ser. No. 13/717,100, filed on Dec. 17, 2012 with claiming foreign priority of TW 100150094. The prior application is herewith incorporated by reference in its entirety.

TECHNICAL FIELD

The present invention relates to a foldable air cushioned structure, and more particularly to a foldable air cushioned structure with clasp points.

BACKGROUND

An air tight enclosure is made of resin film, and formed into air-tight air cylinders by means of heat-sealing. Furthermore, an air filling entrance for air filling is disposed therein, allowing the air tight enclosure to cushion a packed object after air is filled into the air cylinders via the air filling entrance.

Among air-filling air cylinder technologies, there is a cushioning air bag with a free opening, or a hammock structure of cushioning air bag; however they all have a common problem, i.e. the air cylinder cylinders must be formed as a face body to have a cushioning force if a corner, rhomboidal angle or edge of the enclosure is hit when an internal object drops. But, when the object drops to hit the enclosure with an acute angle thereof, a single air cylinder must be used to response the edge or rhomboidal angle of the object. However, the air cylinder cannot withstand one-dot or one-line impact force such that the cushioning protection of the object cannot be effected.

In common, the object is placed at a surface arranged with column of air cylinders. However, the weight of the object would make contact of two outer film of the air cylinders, and form deformation in some area. Further, the air flow and pressure would make some breakdown in the air cylinders, and reduce the cushion effect.

SUMMARY

To address these issues, the present invention provides a foldable air cushioned structure. The foldable air cushioned structure comprises a plurality of heat-sealing lines, a plurality of air cylinders, a plurality of nodes and a plurality of clasp points. The heat-sealing lines are formed by linear heat-sealing for attaching parts of two outer films. The heat-sealing lines are arranged in order, and the air cylinders are positioned between the heat-sealing lines. The nodes are formed inside the air cylinders by heat-sealing for attaching parts of the inner surfaces of respective outer films, and the nodes are arranged in lines perpendicular to the heat-sealed lines to form a plurality of foldable lines. The clasp points are formed on the outer surfaces of two outer films by heat-sealing for attaching parts of the outer surfaces of two outer films.

After folding the air cylinders along the folding lines, each of the air cylinders forms two side portions, at least one supporting portion and at least two bottom portions. Two side portions form a receiving space therebetween. Further, the air cylinders at two side can be bent and heat-sealed to form the receiving space surrounded with the side portions.

The supporting portion forms at least one convex in the receiving space. The supporting portion comprises a propping section and two connecting sections positioned at two sides of the propping section after the air cylinders are folded via the nodes. The bottom portions connects to at least one of the connecting sections and the side portions. The bottom portion forms a concave between the connecting sections and adjacent side portions.

The technical characteristics of the foldable air cushioned structure of the present invention is folding the air cylinder by using via nodes, such that the convex-shaped supporting portion is formed in the receiving space for cushioning. The foldable air cushioned structure uses the pressure along the long-axis of the air cylinder to support the object, but not short-axis between two outer films. The foldable air cushioned structure of the present is much stable and not easily deforming. Even through the object is over-weight, the supporting portion would shrink firstly, but not break down the whole structure.

BRIEF DESCRIPTION OF THE DRAWINGS

The present invention can be more fully understood by reference to the following description and accompanying drawings, in which.

DETAILED DESCRIPTION

Figure 1:
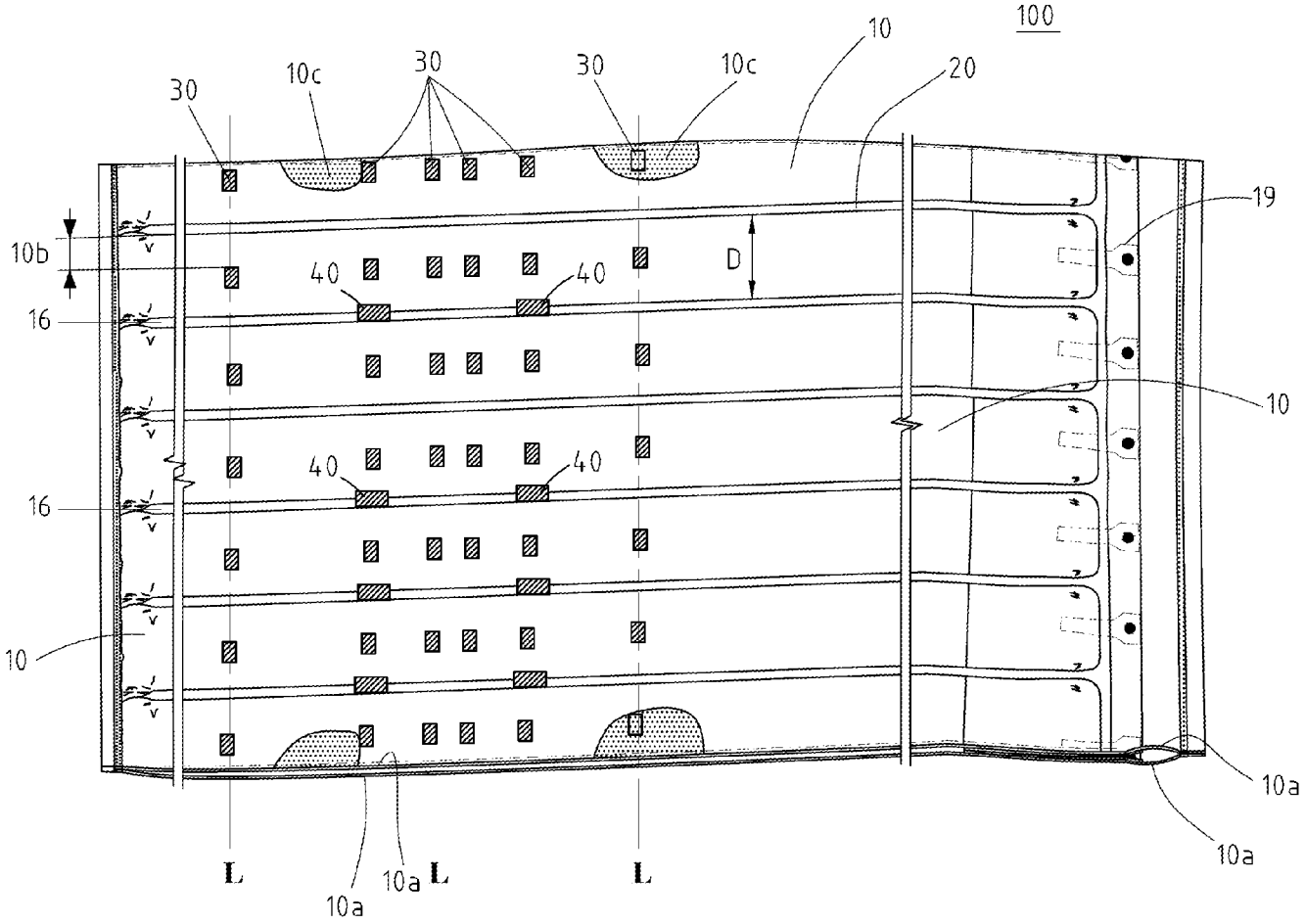
FIG. 1 is a perspective view before folding of a foldable air cushioned structure of a first embodiment according to the present invention.
Figure 2:
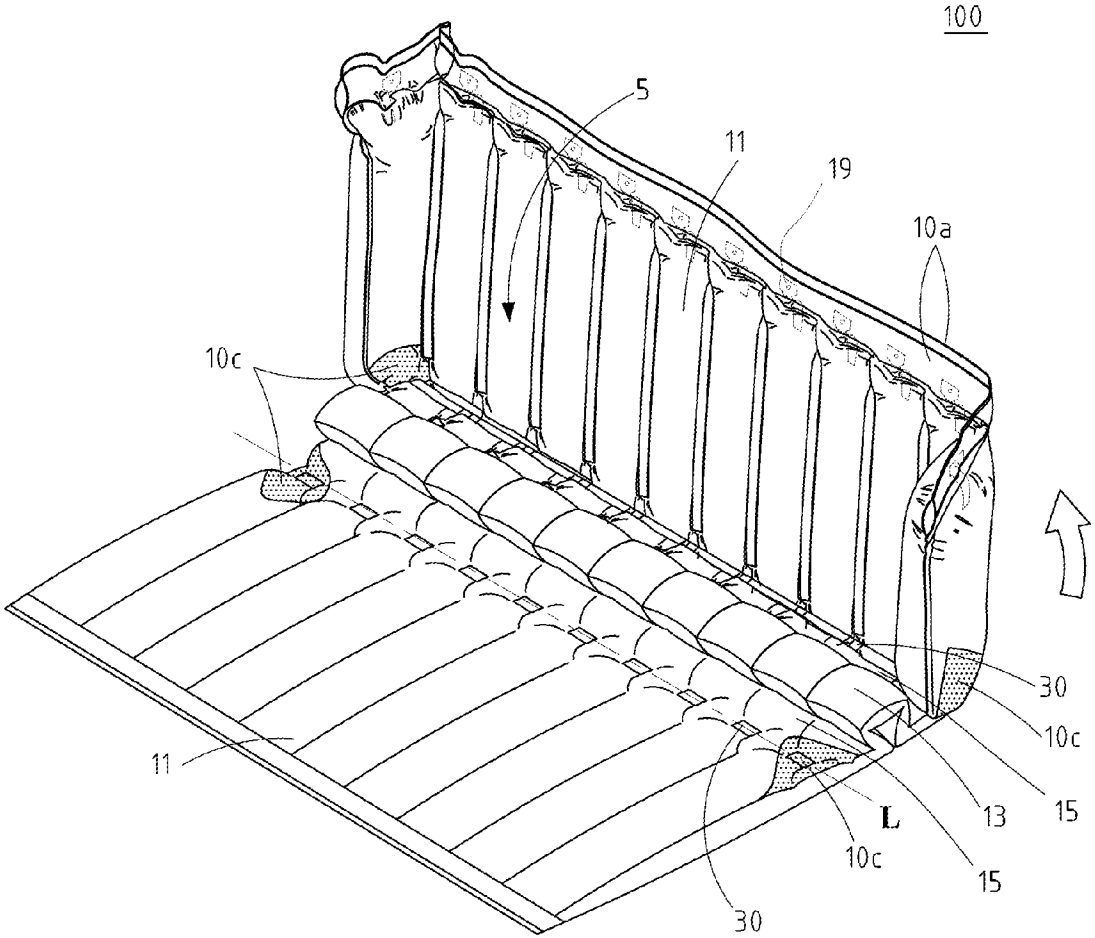
FIGS. 2-4 are schematic views of the foldable air cushioned structure of the first embodiment according to the present invention during folding.
Figure 3:
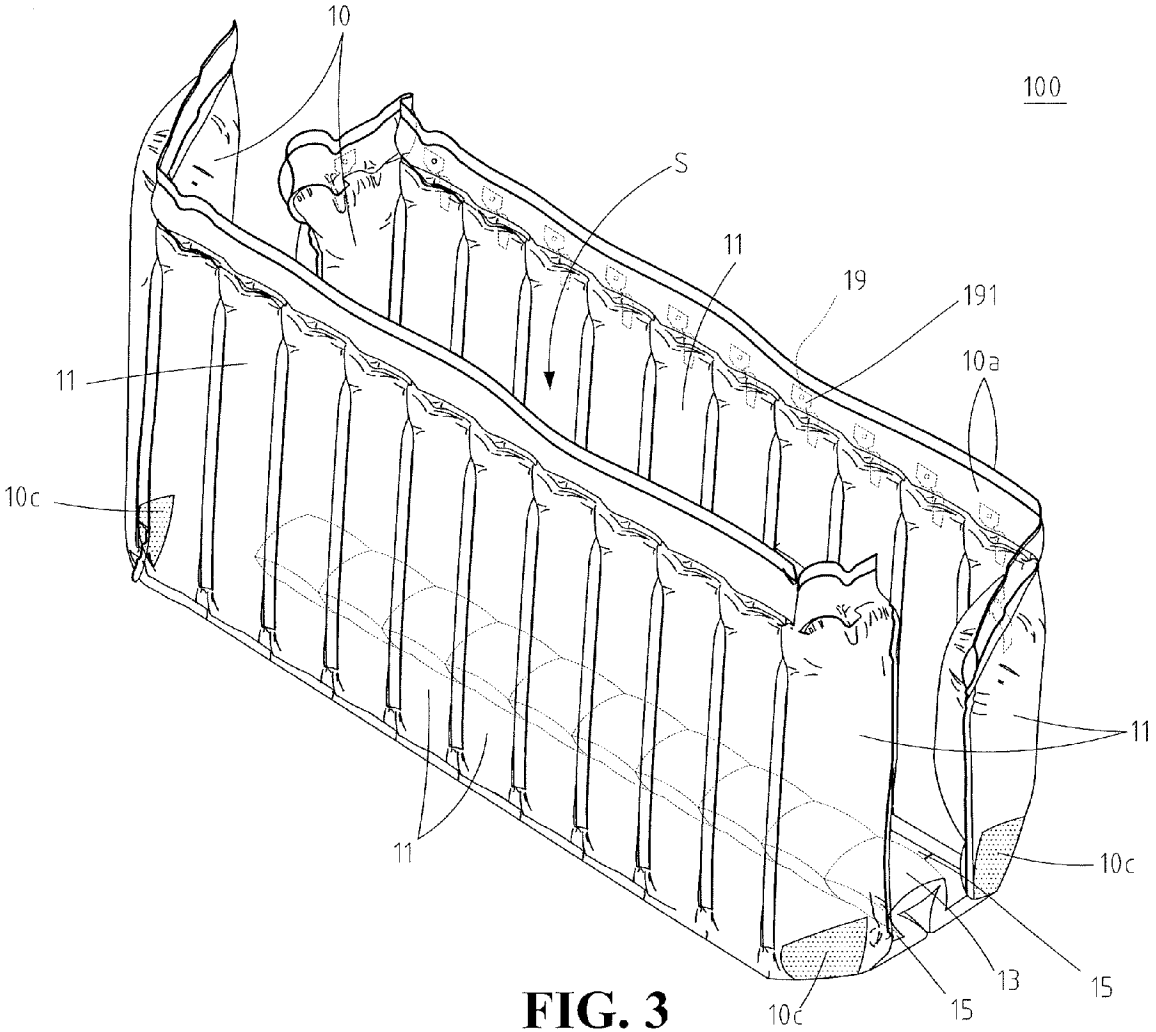
Figure 4:
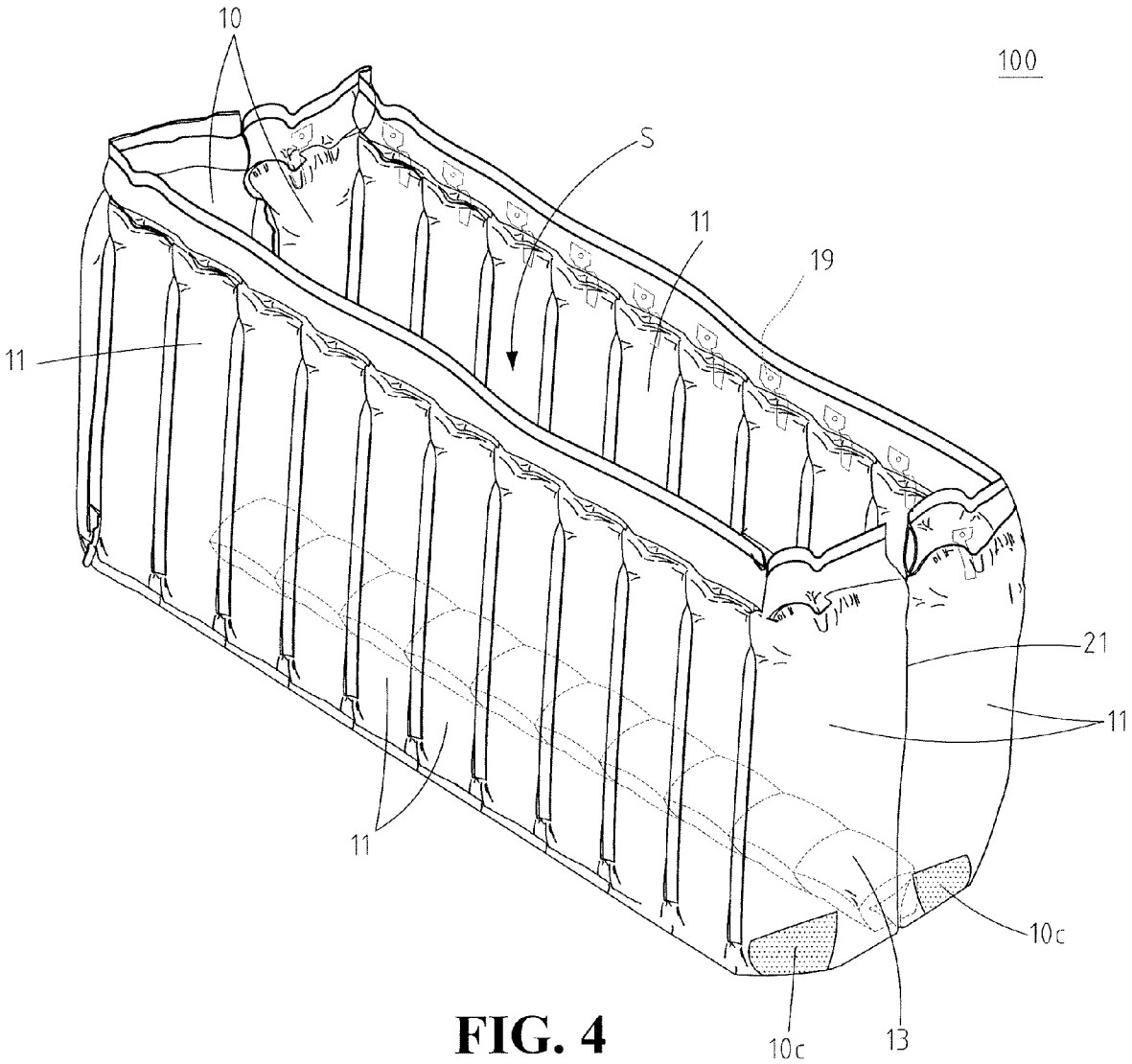
Figure 5:
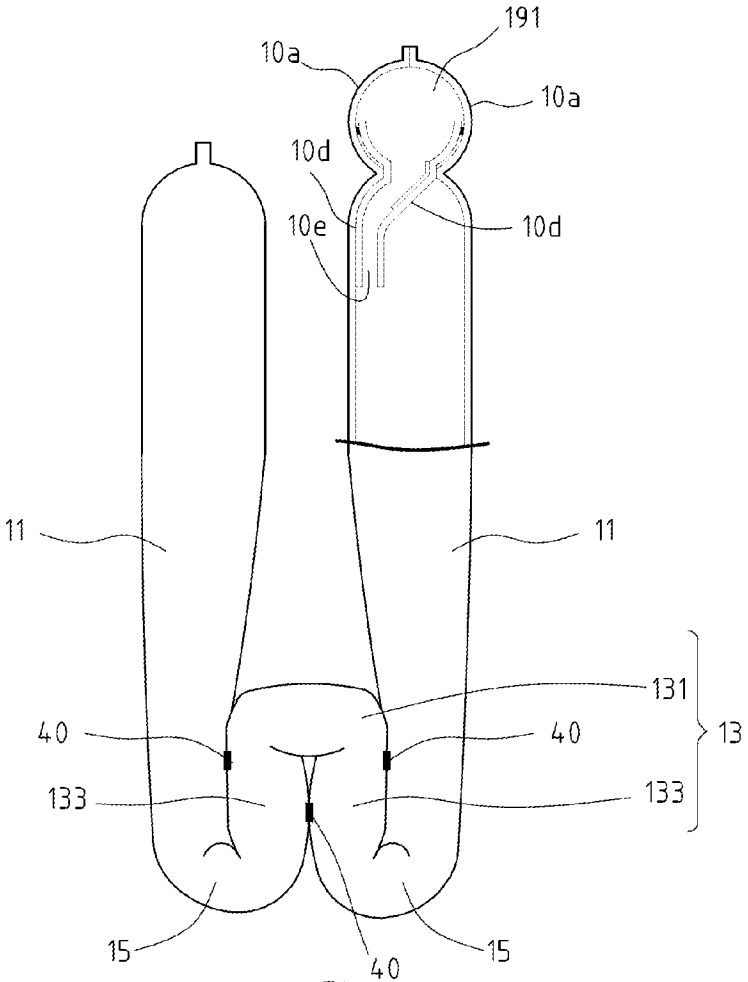
FIG. 5 is a cross-sectional view of the foldable air cushioned structure of the first embodiment according to the present invention.

Please refer to FIGS. 1-5, FIG. I is a perspective view before folding of a foldable air cushioned structure of a first embodiment according to the present invention, FIGS. 2-4 are schematic views of the foldable air cushioned structure of the first embodiment according to the present invention during folding, and FIG. 5 is a cross-sectional view of the foldable air cushioned structure of the first embodiment according to the present invention. As shown in FIG. 1, the foldable air cushioned structure 100 is an air-cylinder sheet before folding. The foldable air cushioned structure 100 comprises a plurality of air cylinders 10, a plurality of heat-sealed lines 20 and a plurality of nodes 30.

The foldable air cushioned structure 100 is made by two outer films 10*a*. The heat-sealing lines 20 are formed by linear heat-sealing the two outer films 10*a* for attaching parts of two outer films 10*a*. The heat-sealing lines 20 are arranged with substantially the same interval D. The air cylinders 10 are formed at the areas which are not heat-sealing after air-filling, and positioned between the heat-sealing lines 20. The nodes 30 are formed inside the air cylinders 10, and partially attach with two inner surfaces of two outer films 10*a*. There is a space 10*b* positioned between the node 30 and the heat-sealed line 20, such that air can filled into the air cylinder 10. Furthermore, the nodes 30 are arranged in lines perpendicular to the heat-sealed lines 20, and form a plurality of foldable lines L. Six foldable lines L are formed in the first embodiment shown in FIG. 1, however, the number of the foldable lines L is not limited.

As shown in FIG. 2, each of the air cylinders 10 forms two side portions 11, a supporting portion 13, and two bottom portions 15 after the air cylinders 10 are folded along the foldable lines L. A receiving space S is formed between the side portions 11. The bottom portion 15 connects the supporting portion 13 and adjacent side portion 11. The bottom portion 15 and the supporting portion 13 have reversed concave-convex structures. The supporting portion 13 forms a convex in the receiving space S for supporting a object. The bottom portion 15 forms a concave between the side portion 11 and the supporting portion 13,and forms a convex to be a support bottom surface outside to support the structure of the foldable air cushioned structure 100.

As shown in FIG. 1, and FIGS. 3-4, the air cylinders 10 which are formed at two sides of the foldable air cushioned structure 100 further comprises at least one air intake stopping blocks 10*c*. The air intake stopping block 10*c* is formed by heat-sealing two adjacent areas of two outer films 10*a*. The air intake stopping blocks 10*c* make the side portions 11 bendable. After bending, the side portions 11 can be attached together by heat sealing 21, such that the side portions 11 surround the receiving space S.

As shown in FIG. 1 and FIG. 5, Each of the air cylinder 10 further comprises an air valve 19 located at one end thereof for air filling. As shown in FIG. 5, each of the air cylinders 10 further comprises two inner films 10*d* therein, the inner films 10*d* are attached to the inner surfaces of the respective outer films 10*a*. An air inlet 10*e* is formed between the inner films 10*d*. For each of the air cylinders 10, after air is filled into the air cylinder 10 from the air valve 19, the air is filled to an inlet passageway 191, then filled into the space between the two outer film 10*a* via the air inlet 10*e*, such that the two outer film 10*c* can be driven to pull apart outward and to expand for forming the air cylinder 10. After air filling, the pressure in the air cylinder 10 would make the two inner films 10*d* attach with each other to seal the air inlet 10*e* and therefore allowing air in the air cylinder 10 not to leak. Moreover, the inlet passageway can be shared by a number of air cylinders 10.

The two outer films 10*a* may be formed of a thermally activated heat-sealable material such as polyester, Polyethylene polypropylene copolymer, Polyethylene terephthalate (PET), ethylene ethyl acetate (EVA), polypropylene (PP), nylon (Nylon), and PE composite membrane, biodegradable material (biodegradable materials), the polymer material coated paper, or the like. But the present invention is not so limited, other materials may be used.

Referring to FIG. 5 again, the supporting portion 13 comprises a propping section 131 and two connecting sections 133. The connecting sections 133 are positioned at two sides of the propping section 131 after the air cylinders 10 are folded via the nodes 30. The nodes 30 are formed between each of the side portions 11 and the adjacent bottom portion 15, and between each of the bottom portions 15 and the adjacent supporting portion 13. The connecting section 133 is connected to the propping section 131 and adjacent bottom portion 15. Furthermore, the foldable air cushioned structure 100 further comprises a plurality of clasp points 40 formed on the outer surfaces of the outer films 10*a* to attach the two outer films 10*a*. The clasp points 40 can be implemented by heat-sealing. As shown in FIG. 5, the clasp point 40 is positioned corresponding to two adjacent connecting section 133 to attach two adjacent connecting section 133. Some of the clasp points 40 are also positioned corresponding to one of the connecting sections 133 and adjacent side portion 11 to the connecting sections 133 and adjacent side portion 11 for providing strength of the foldable air cushioned structure 100. In addition, the clasp points 40 are positioned on heat-sealing lines 20.

Figure 6:
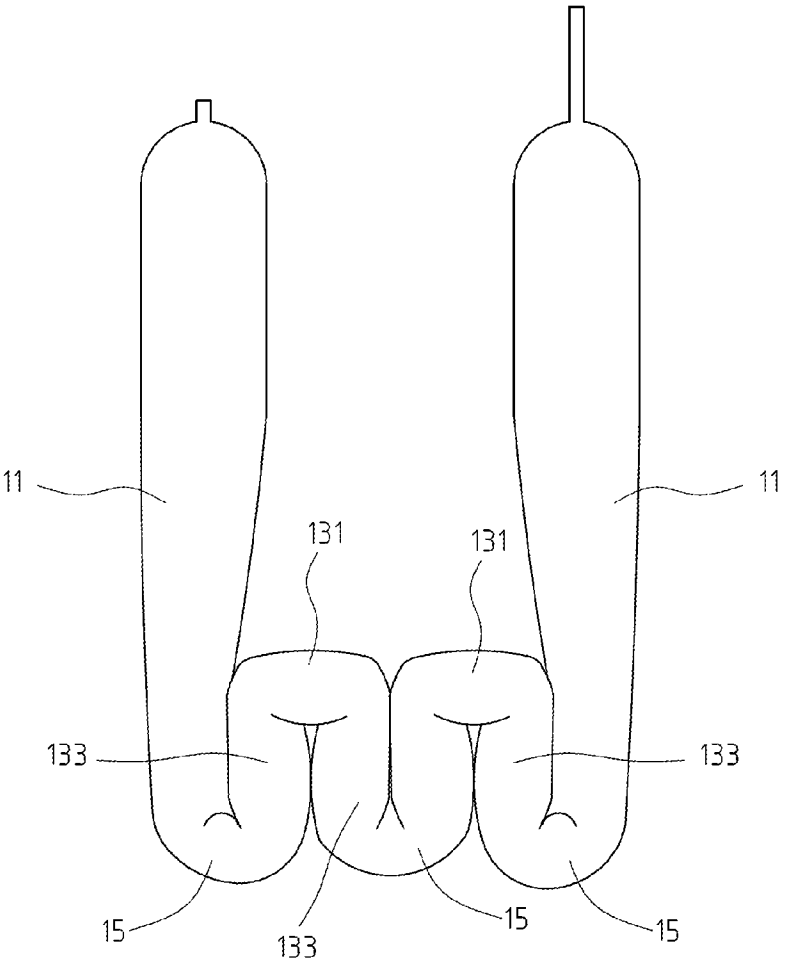
FIG. 6 is a cross-sectional view of the foldable air cushioned structure of a second embodiment according to the present invention.

Please refer to FIG. 6, a cross-sectional view of the foldable air cushioned structure of a second embodiment according to the present invention. As shown in FIG. 6, the number of nodes 30 are increased in the second embodiment for increasing the foldable lines L, and two supporting portions 13 and three bottom portions 15 are formed. One of the bottom portions 15 is connected to two adjacent connecting sections 131, the rest two bottom portions 15 each are connected to one of the connecting sections 131 and the adjacent side portion 11. The number of the supporting portions 13 and the bottom portions 15 may be adjusted to satisfy the requirement by adjusting the number of nodes 30.

Figure 7:
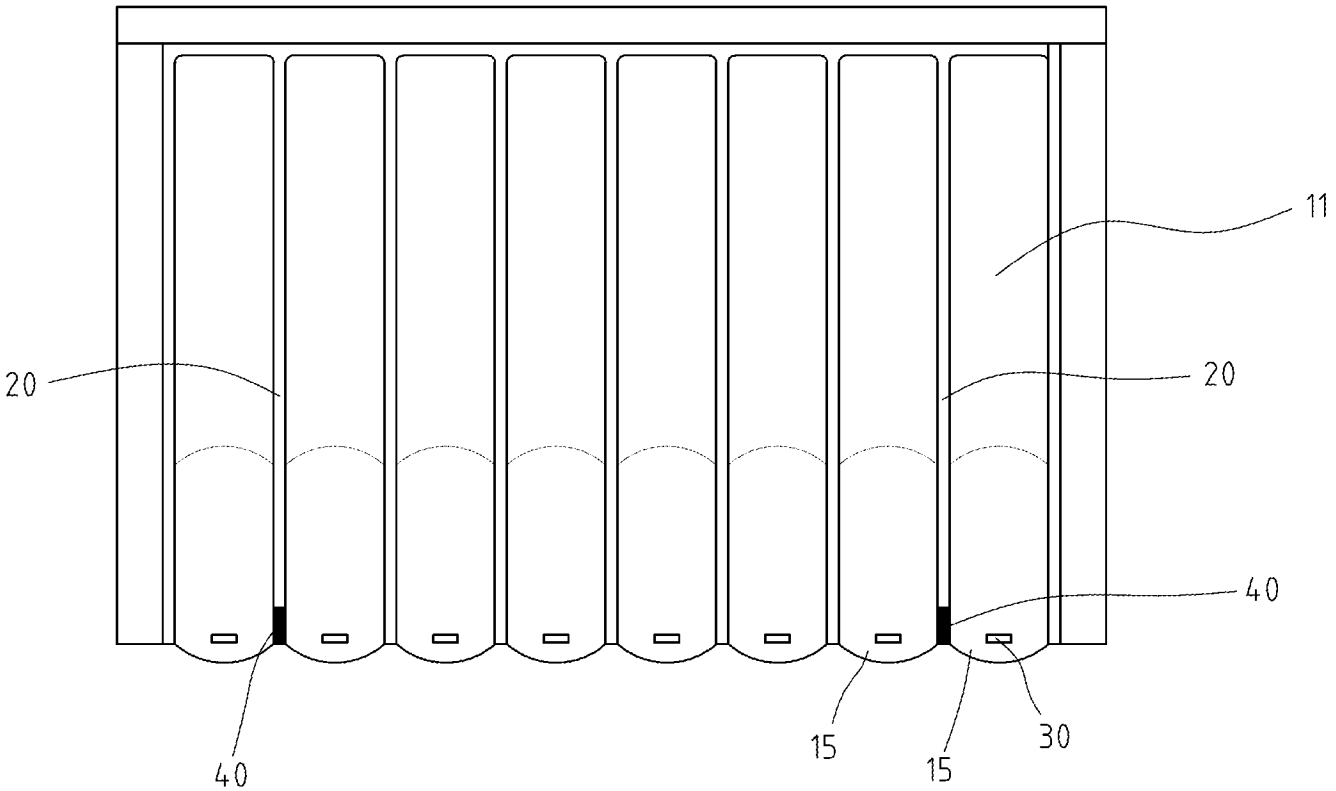
FIG. 7 is a side view of the foldable air cushioned structure of a third embodiment according to the present invention.
Figure 8:
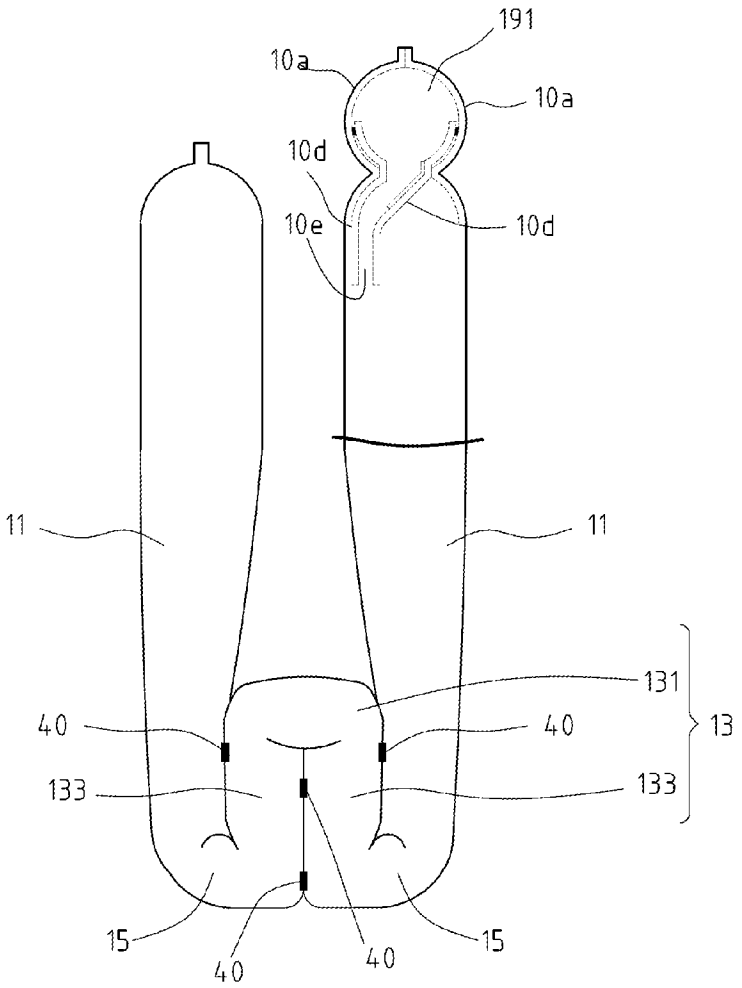
FIG. 8 is a cross-sectional view of the foldable air cushioned structure of the third embodiment according to the present invention.

Please refer to FIG. 7 and FIG. 8, a side view and a cross-sectional view of the foldable air cushioned structure of a third embodiment according to the present invention. As shown in FIG. 7 and FIG. 8 , the foldable air cushioned structure 100 of the third embodiment comprises clasp points 40 positioned on the heat-sealing and near the bottom portions 15 of the air cylinders 10 which are at two sides of the foldable air cushioned structure 100, and each of the clasp points 40 is attached to a corresponding heat-sealing line 20. Therefore, the bottom portions 15 are pulled closely, and the cushioning at the sides is enhanced. The clasp points 40 are formed by heat sealing. In FIG. 7 and FIG. 8, some of the clasp points 40 are positioned on the heat sealing line 20 next to the outermost heat-sealing lines 20.

Figure 9:
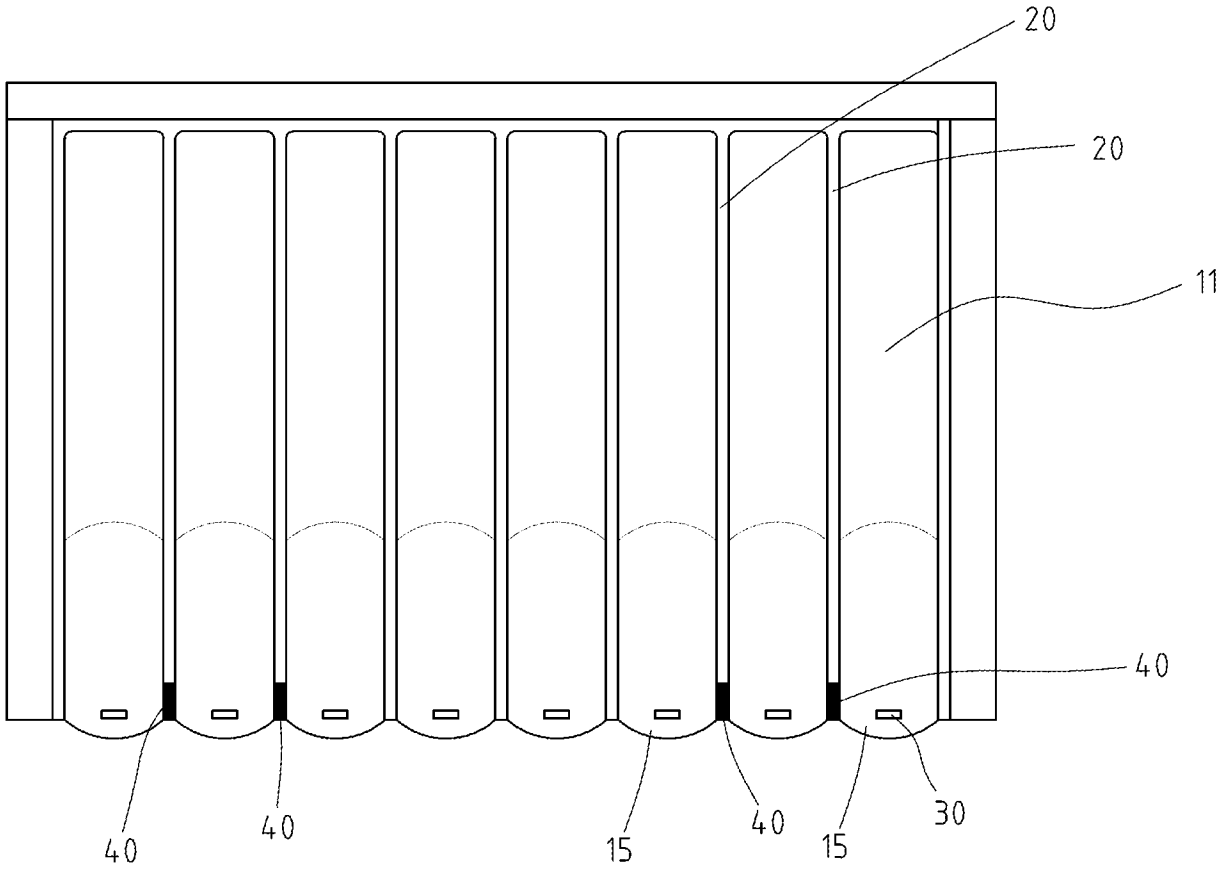
FIG. 9 is a side view of the foldable air cushioned structure of a fourth embodiment according to the present invention.

Please refer to FIG. 9, a side view of the foldable air cushioned structure of a fourth embodiment according to the present invention. As shown in FIG. 9, the foldable air cushioned structure 100 of the fourth embodiment further comprises clasp points 40 positioned on the heat-sealing lines 20 and near the bottom portions 15. Some of the clasp points 40 are positioned on the heat sealing lines 20 next to the outermost heat-sealing lines 20, and some of the clasp points 40 are also positioned on the other heat-sealing line 20 in the central area. Therefore, the cushioning at the sides can be further enhanced.

Figure 10:
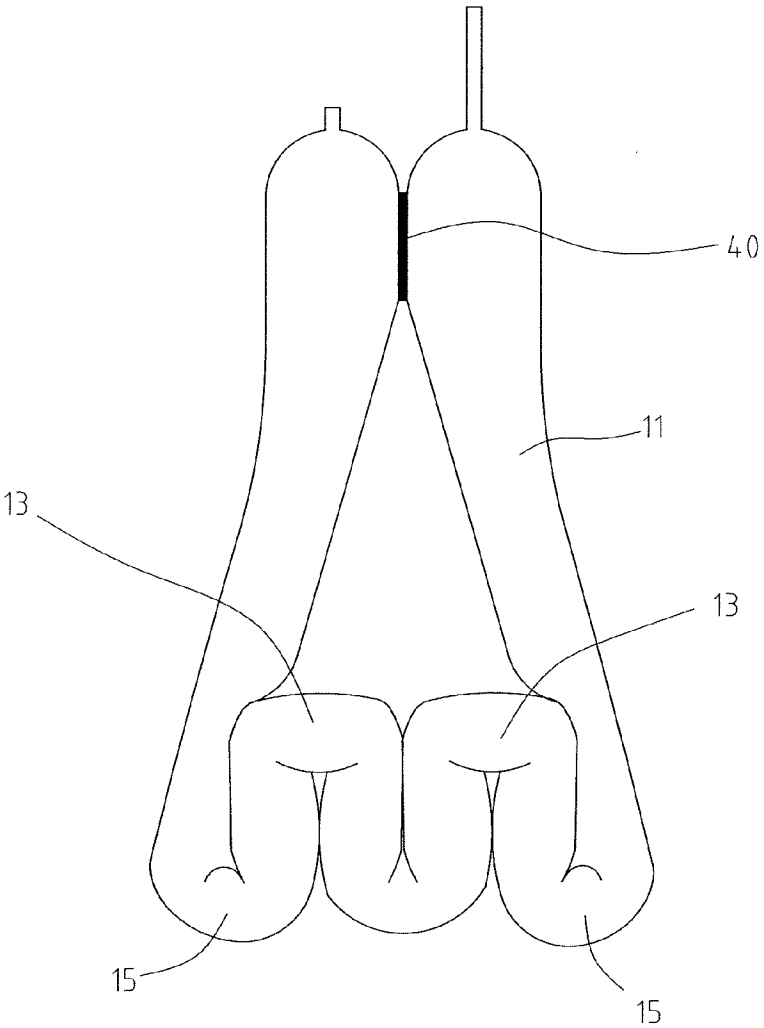
FIG. 10 is a cross-sectional view of the foldable air cushioned structure of a fourth embodiment according to the present invention.
Figure 11:
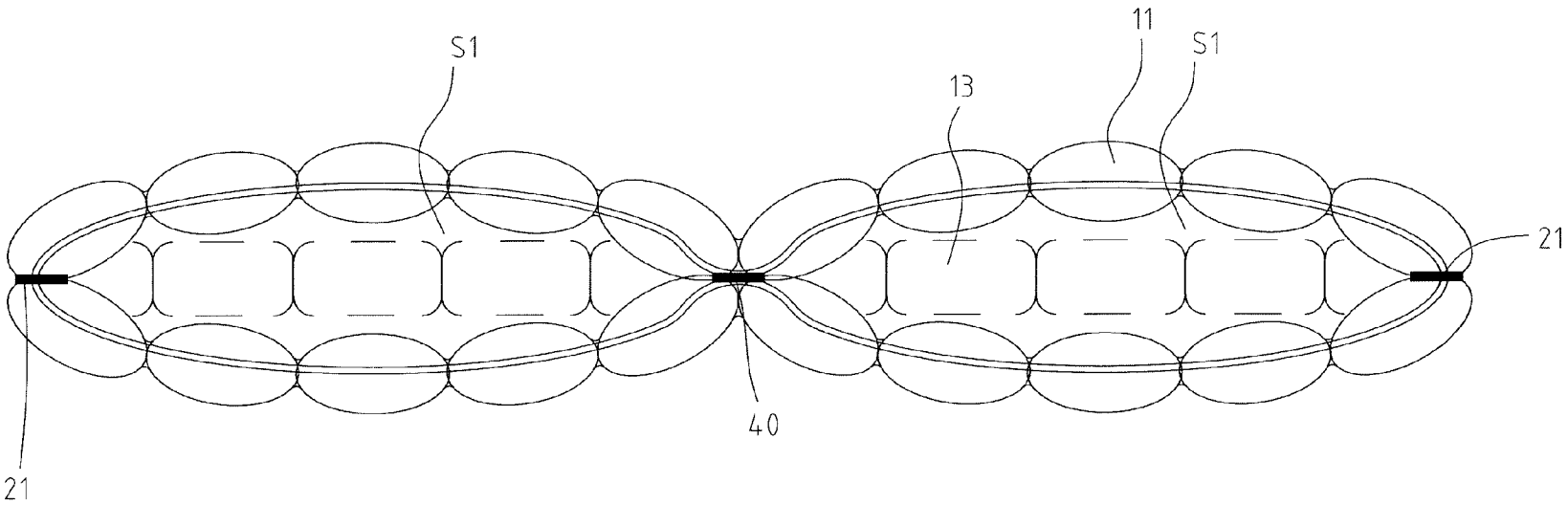
FIG. 11 is a top view of the foldable air cushioned structure of a fifth embodiment according to the present invention.

Please refer to FIG. 10 and FIG. 11, a cross-sectional view and a top view of the foldable air cushioned structure of a fifth embodiment according to the present invention. As shown in FIG. 10 and FIG. 11, the foldable air cushioned structure 100 of the fifth embodiment further comprises clasp points 40 formed on the heat-sealing line 20 and positioned near the side portions 15 of the air cylinders 10, and the clasp points 40 is attached to a corresponding heat-sealing line 20 especially the clasp points 40 are positioned on the heat-sealing lines 20 and near the top end of the side portion 11 and near the opening of the received space S, such that the foldable air cushioned structure 100 of the fifth embodiment has two received spaces S1. The clasp points 40 are formed by heat sealing.

The embodiments described above, the common technical characteristic is folding the air cylinder 10 by using nodes 30, such that the supporting portion 13 is formed in the receiving space S for cushioning. The foldable air cushioned structure used the pressure along the long-axis of the air cylinder 10 to support the object, but not short-axis between two outer films 10*a*. The foldable air cushioned structure of the present invention is stable and not easily deforming. Even through the object is over-weight, the supporting portion 13 would shrink firstly but not break down the whole structure.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A foldable air cushioned structure formed by two outer films, comprising:

a plurality of heat-sealing lines formed by linear heat-sealing the two outer films for attaching parts of the two outer films, wherein the heat-sealing lines are arranged with substantially the same interval;

a plurality of air cylinders positioned between the heat-sealing lines;

a plurality of nodes disposed inside the air cylinders by heat-sealing for attaching parts of the inner surfaces of the two outer films, wherein the nodes are arranged in lines perpendicular to the heat-sealed lines to form a plurality of foldable lines; and a plurality of clasp points formed on the outer surface of the two outer films by heat-sealing for attaching parts of the outer surfaces of the two outer films, wherein after folded along the foldable lines, each of the air cylinders forms:

two side portions forming a receiving space therebetween;

at least one supporting portion formed in the receiving space and the supporting portion comprising a propping section and two connecting sections positioned at two sides of the propping section after the air cylinders are folded via the nodes, wherein at least one of the clasp points is positioned corresponding to two adjacent connecting sections to attach the two adjacent connecting sections, and at least two of the clasp points are positioned corresponding to one of the connecting sections and the adjacent side portion to attach the connecting sections and the adjacent side portion; and at least two bottom portions connecting to at least one of the connecting sections and the side portions, wherein each of the bottom portions is formed a support bottom surface between each of the side portions and the adjacent connecting section or between two adjacent connecting sections.

2. The foldable air cushioned structure according to claim 1, wherein the nodes are formed between each of the side portions and the adjacent bottom portion, and between each of the bottom portions and the adjacent supporting portion.

3. The foldable air cushioned structure according to claim 1, wherein at least two of the clasp points are positioned on the heat-sealing lines and near the bottom portions of the air cylinders, and each of the clasp points is attached to a corresponding heat-sealing line.

4. The foldable air cushioned structure according to claim 1, wherein at least two of the clasp points are positioned on the heat-sealing lines next to the outermost heat-sealing lines.

5. The foldable air cushioned structure according to claim 1, wherein at least one of the clasp points are positioned on the heat-sealing line near the top end of the side portions of the air cylinders, and the clasp point is attached to a corresponding heat-sealing line.

6. The foldable air cushioned structure according to claim 1, wherein the clasp points are positioned at the heat-sealing lines.

7. The foldable air cushioned structure according to claim 1, wherein the air cylinders which are formed at two sides of the foldable air cushioned structure further comprise at least one air intake stopping blocks for bending the side portions, and the air intake stopping blocks are formed by heat-sealing two adjacent areas of two outer films.

8. The foldable air cushioned structure according to claim 1, wherein each of the air cylinders comprises an air valve and two inner films, the air valve is positioned at one end of the air cylinder, the inner films are positioned inside the air cylinder and connected to the respective outer films, an air inlet is formed between the inner films, wherein when the air is filled from the air valve through an inlet passageway then filled into the space between the two outer films to driven to pull apart outward and expand for forming air cylinder, and pressure in the air cylinder make the two inner films attach the each other to seal the air inlet.

9. The foldable air cushioned structure according to claim 8, wherein inlet passageway connects to the air cylinders.

* * * * *